US007918065B2

(12) United States Patent
Ito

(10) Patent No.: US 7,918,065 B2
(45) **Date of Patent: *Apr. 5, 2011**

(54) FASTENING MEMBER AND EXTERNAL WALL CONSTRUCTION STRUCTURE USING THE SAME

(75) Inventor: Tsuneaki Ito, Kuwana (JP)

(73) Assignee: Nichiha Corporation, Nagoya-shi (JP)

( * ) Notice: Subject to any disclaimer, the term of this patent is extended or adjusted under 35 U.S.C. 154(b) by 753 days.

This patent is subject to a terminal disclaimer.

(21) Appl. No.: 11/891,631

(22) Filed: Aug. 10, 2007

(65) Prior Publication Data

US 2008/0053024 A1 Mar. 6, 2008

(30) Foreign Application Priority Data

Aug. 11, 2006 (JP) ..... 2006-006589 U

(51) Int. Cl.
*E04B 2/00* (2006.01)

(52) U.S. Cl. ..... 52/506.05; 52/489.1; 52/506.06; 52/509; 52/543

(58) Field of Classification Search ..... 52/478, 52/489.1, 489.2, 506.05, 560.06, 506.08, 52/506.09, 510, 543, 546, 547, 509; 403/381
See application file for complete search history.

(56) References Cited

U.S. PATENT DOCUMENTS 2,395,726 A * 2/1946 Del Tufo ..... 52/509
4,074,486 A * 2/1978 Grearson ..... 52/235
4,516,373 A * 5/1985 Osawa ..... 52/387
4,523,413 A * 6/1985 Koppenberg ..... 52/139
5,239,798 A * 8/1993 Saito ..... 52/235
5,265,396 A * 11/1993 Amimoto ..... 52/745.12
5,619,834 A * 4/1997 Chen ..... 52/509
6,170,214 B1 * 1/2001 Treister et al. ..... 52/511
6,289,646 B1 * 9/2001 Watanabe ..... 52/506.01
6,499,261 B2 * 12/2002 Hikai ..... 52/235
6,843,032 B2 * 1/2005 Hikai ..... 52/287.1
2002/0020130 A1 * 2/2002 Hikai ..... 52/518

FOREIGN PATENT DOCUMENTS

JP 2000-291225 10/2000
JP 2006-37567 2/2006

* cited by examiner

*Primary Examiner* — Brian E Glessner
*Assistant Examiner* — Adriana Figueroa
(74) *Attorney, Agent, or Firm* — Edwards Angell Palmer & Dodge LLP

(57) ABSTRACT

A fastening member which can fix with sufficient strength siding boards whose lateral joint portions are disposed in a portion where no vertical member is provided and prevent displacement in the vertical direction, is capable of ensuring a ventilation space without using furring strips and has excellent durability, and an external wall construction structure using the same are provided. A fastening member 1 has a long fixing plate portion 11 which is fixed to at least one vertical member 21. On the front surface of the long fixing plate portion 11, a first fastening portion 12 for supporting and engaging the upper end portion in the lateral joint portions 39 of a siding board 3 and the lower end portion of the siding board thereabove, a vertical rising portion 13 for preventing displacement disposed in the lateral joint portions below the first fastening portion 12, and a second fastening portion 14 for engaging the upper end portion of the siding board in the portion other than the lateral joint portions 39 and supporting and engaging the lower end portion are provided. Each fastening portion is provided with a ventilating spacer between itself and the long fixing plate portion 11, thereby ensuring a sufficient ventilation space.

19 Claims, 15 Drawing Sheets

Flg. 11

PRIOR ART

PRIOR ART

FASTENING MEMBER AND EXTERNAL WALL CONSTRUCTION STRUCTURE USING THE SAME

CROSS-REFERENCE TO RELATED APPLICATIONS

This application claims priority under 35 U.S.C. §119(a) to Japanese patent application no. JP 2006-006589U, filed on Aug. 11, 2006. The contents of this application are incorporated herein by reference in their entirety.

FIELD OF THE INVENTION

The present invention relates to a fastening member for fixing a siding board whose lateral joint portions are disposed in a portion where no vertical member is provided in a framework of a building to the above framework, and an external wall construction structure using the same.

DESCRIPTION OF THE RELATED ART

The framework construction method has been conventionally employed as a construction method of buildings. In this framework construction method, furring strip backing set is normally built as modules of 455 mm. Specifically, the intervals of posts and studs to which the furring strips are applied are set to 455 mm. This is a basic dimension commonly employed in the Japanese wooden stand-alone house building field.

For this reason, the dimensions of siding board products fixed are designed and produced to have the horizontal width dimension of the integer multiple of 455 mm to fit the above basic dimension of the furring strip backing set (e.g., 455 mm×4=1820 mm).

However, in recent years, there are many cases where the intervals of posts and studs are different from the above-mentioned basic dimension, 455 mm. For example, the intervals of 500 mm as in meter modules and 24 inches (610 mm) are often employed. In such a case, when such siding boards are fixed to posts and studs, portions where the left and right ends of the above siding boards cannot be disposed on the posts and studs are disadvantageously formed. Since these portions are not supported by frameworks such as posts and studs, the fixing force of the siding boards to the frameworks may not be sufficiently ensured.

As a solution for such problems, Japanese Unexamined Laid-open Patent Publication No. 2006-37567 disclosed a fastening member and external wall construction structure using the same, and a method of attaching an external wall. As shown in FIG. 15, the patent publication suggests a technique of fastening siding board to a framework 2 using a fastening member 9 fixed to a vertical member (post, stud) 21.

This fastening member 9, as shown in FIG. 15, has a long fixing plate portion 11 fixed to at least one vertical member 21, and is provided with a first fastening portion 12 for engaging the upper end portion in the lateral joint portions of the siding board and supporting and engaging the lower end portion of the siding board disposed thereabove at the left end of the front surface of the long fixing plate portion 11, a vertical rising portion 13 for preventing displacement disposed in the lateral joint portions mentioned above below the first fastening portion 12, and a second fastening portion 14 for engaging the upper end portion of the siding board and supporting and engaging the lower end portion of the siding board disposed thereabove at the right end of the front surface of the long fixing plate portion 11.

The vertical rising portion 13 for preventing displacement of the fastening member 9 mentioned above is brought into contact with right side edge of the siding board disposed on the left side thereof, and is disposed in the upper side portion and lower side portion of the lateral joint portion of the neighboring siding boards to engage the two siding boards therebelow and the two siding boards thereabove by the first fastening portion 12 and the second fastening portion 14.

At this time, the above fastening member 9 is fixed to the above vertical member 21 with nails 91.

However, as shown in FIG. 13, when the fastening member 9 is fixed to the vertical member 21 with a moisture-permeable waterproof sheet 7 placed therebetween, variations in application result in waviness in the moisture-permeable waterproof sheet and other problems, whereby ensuring a space formed between the rear side surface 36 of the siding board 3 and the moisture-permeable waterproof sheet 7, that is, a ventilation space 8, is disadvantageously disabled.

Herein, the moisture-permeable waterproof sheet 7 serves as a waterproof layer which prevents backward permeation (permeation into the building) of rainwater which has entered into the ventilation space 8 and a condensate generated on the rear side surface 36 of the siding board 3, but discharges the rainwater and condensate downwardly. The moisture-permeable waterproof sheet 7 also serves as a moisture-permeable layer which allows water vapor generated indoors (inside the building) to flow forwardly (into the ventilation space 8).

As shown in the FIG., if the moisture-permeable waterproof sheet 7 is slackly hanged, the ventilation space 8 is closed and a space for the moisture inside the ventilation space 8 to move upwardly is not ensured, whereby the moisture is stagnated inside the ventilation space 8. Similarly, rainwater and condensate entering into the ventilation space 8 flow down and thus becomes difficult to be discharged to the outdoor, and water stagnates inside the ventilation space 8. This stagnation of moisture and water causes the rear side surface 36 of the siding board 3 to absorb moisture and water. Consequently, problems such as warping, enlargement and shrinkage of the siding board 3 are disadvantageously caused. This problem is especially serious in fiber reinforced cement siding type siding boards.

Meanwhile, as shown in FIG. 14, to sufficiently ensure the ventilation space 8, the structure in which the fastening member 9 and the furring strips 22 are used in combination is possible. In this structure, the fastening member 9 is fixed to the vertical member 21 with the moisture-permeable waterproof sheet 7 and the furring strips 22 placed therebetween, and the sufficient ventilation space 8 is ensured between the moisture-permeable waterproof sheet 7 and the rear side surface 36 of the siding board 3, excluding the portions of the furring strips 22 fixed in the vertical direction. However, the furring strips 22 need to be fixed to the vertical member 21 in advance before the fastening member 9 is fixed. Accordingly, working man-hours and material costs are disadvantageously increased. That is, in such application, a number of the furring strips 22 having a standard dimension need to be prepared, and a working step of fixing the furring strips 22 to the vertical member 21 with nails and the like are also necessary.

SUMMARY OF THE INVENTION

The present invention was made to solve the above-mentioned known problems, and an object of the invention is to provide a fastening member which can ensure a sufficient ventilation space without using furring strips, fix a siding board whose lateral joint portions are disposed in a portion where no vertical member is provided with sufficient strength, and prevent 'displacement' in the vertical direction in one step, and an external wall construction structure using the same.

The object of the present invention mentioned above is achieved by a fastening member for fixing on a framework of a building a siding board whose lateral joint portions are disposed in a portion where no vertical member is provided on the framework, the fastening member comprising a long fixing plate portion fixed on at least one vertical member, a first fastening portion having a fixture for supporting and engaging an upper end portion of the lateral joint portions of the siding board and a lower end portion of the siding board thereabove on the front surface of the long fixing plate portion, a vertical rising portion for preventing displacement disposed in the lateral joint portions of the siding board below the first fastening portion, a second fastening portion having a fixture for engaging the upper end portion of the siding board other than the lateral joint portions and for supporting and engaging the lower end portion of the siding board other than the lateral joint portions on the front surface of the long fixing plate portion, and a ventilating spacer provided in the first fastening portion and second fastening portion and nipped between the long fixing plate portion and each of the fastening portions, respectively.

The object of the present invention mentioned above is effectively achieved by a fastening member in which the ventilating spacer has a bent portion which is perpendicularly bent from each side of an approximately rectangle-shaped metal plate rearwardly, and an opening portion in an approximate center, and further the bent portion has a reinforcing rib which is the metal plate locally deformed and a reinforcing protrusion in the opening portion.

Moreover, the object of the present invention mentioned above is further effectively achieved by a fastening member in which the ventilating spacer has a drain hole in the bent portion.

The object of the present invention mentioned above is further effectively achieved by a fastening member in which a portion around the opening portion of the long fixing plate portion is protruded, the opening portion of the ventilating spacer and the opening portion of each fixture are aligned relative to the opening portion, and the bent portion of the ventilating spacer and the edge of the reinforcing protrusion are brought into contact with the long fixing plate portion, and in a state that the fixture is in contact with the ventilating spacer, the raised portion around the opening portion in the long fixing plate portion projects forwardly beyond the opening portion of each fixture, and this protruding portion is rearwardly bent on the front surface of each fixture and pressed against the front surface portion of the long fixing plate portion, whereby the ventilating spacer and each fixture are integrally fixed to the long fixing plate portion.

The object of the present invention mentioned above is further effectively achieved by a fastening member in which the first fastening portion has a plurality of flange portions which are formed by subjecting a portion of the long fixing plate portion to a cutting and bending process, and the fixture is mounted on the flange portions in direct contact with the flange portions.

The object of the present invention mentioned above is further effectively achieved by a fastening member in which the first fastening portion is provided at one end of the long fixing plate portion, and the second fastening portion is provided at the other end of the long fixing plate portion.

The object of the present invention mentioned above is further effectively achieved by a fastening member which further has a third fastening portion having a shape and function similar to those of the second fastening portion.

The object of the present invention mentioned above is further effectively achieved by a fastening member in which a fixture constituting the first fastening portion is a fixture having a stopper for preventing displacement which comprises a vertical rising portion for preventing displacement integrally formed thereon.

The object of the present invention mentioned above is further effectively achieved by a fastening member in which the long fixing plate portion has a rib portion protruding forwardly in the lateral direction and a lower side bent portion bent forwardly from the lower side of the long fixing plate portion formed thereon.

The object of the present invention mentioned above is further effectively achieved by an external wall construction structure using the fastening member.

The object of the present invention mentioned above is further effectively achieved by an external wall construction structure wherein the framework has a vertical member disposition span of 500 to 610 mm, and the long fixing plate portion has a horizontal length of 540 to 650 mm.

Effects of the Invention

According to the fastening member of the present invention and the external wall construction structure using the same, a step of fixing furring strips for providing a ventilation space on the framework in advance is unnecessary, thereby improving operation efficiency. Moreover, since furring strips are unnecessary, material costs can be greatly reduced. Furthermore, a sufficient ventilation space can be ensured by a ventilating spacer provided on the fastening member in advance, and even in a case where the lateral joint portions of the siding board are disposed in a portion where there are no vertical member, which is a framework, is provided because of the limitation of the construction structure and application position and it is therefore difficult to fix the lateral joint portions of the siding board to a vertical member, the siding board whose lateral joint portions are disposed in a portion where no vertical member is provided can be fixed with sufficient strength. Moreover, because of the unique configuration of the ventilating spacer, external forces transmitted to the siding board such as wind pressure can be transmitted smoothly to a vertical member, which is a framework, via the ventilating spacer. In addition, the 'displacement' of the siding board in the vertical direction can be prevented. Further, in the upper end portion of the lateral joint portions of the siding board, when the fastening member is disposed on the upper end portions of the horizontally adjacent siding boards, the siding boards can be engaged while the panels can be aligned on a horizontal straight line by simultaneously bringing the fastening member into contact with the upper end portions of the siding boards. Therefore, displacement between the joints of the horizontally adjacent siding boards in the horizontal direction can be reduced, and the aesthetic quality of the finished external walls can be improved. Moreover, in the lower end portion of the siding board disposed above the siding board mentioned above, the fastening member supports the lower end portion of the siding board on a straight line in the horizontal direction, whereby the influence of the unevenness of the framework and a plurality of vertical members in the longitudinal direction can be reduced and the siding boards can be engaged without warping. This can also improve the aesthetic quality.

Thus, the fastening member according to the present invention and the external wall construction structure using the same can provide the following great advantages: a sufficient ventilation space can be ensured between a siding board and the framework; installment is easy and installment costs can be reduced; the fixing strength of the siding board is good and therefore the effect of preventing displacement is high; and displacement or warping of joints can be prevented, which can also improve the aesthetic quality.

BRIEF DESCRIPTION OF THE DRAWINGS

The preferred embodiments of the present invention are shown by way of example, and not limitation, in the accompanying figures, in which.

DETAILED DESCRIPTION OF THE PREFERRED EMBODIMENTS

Embodiment

Exemplary embodiments of the present invention will be described with reference to FIGS. 1 to 12.

Figure 1:
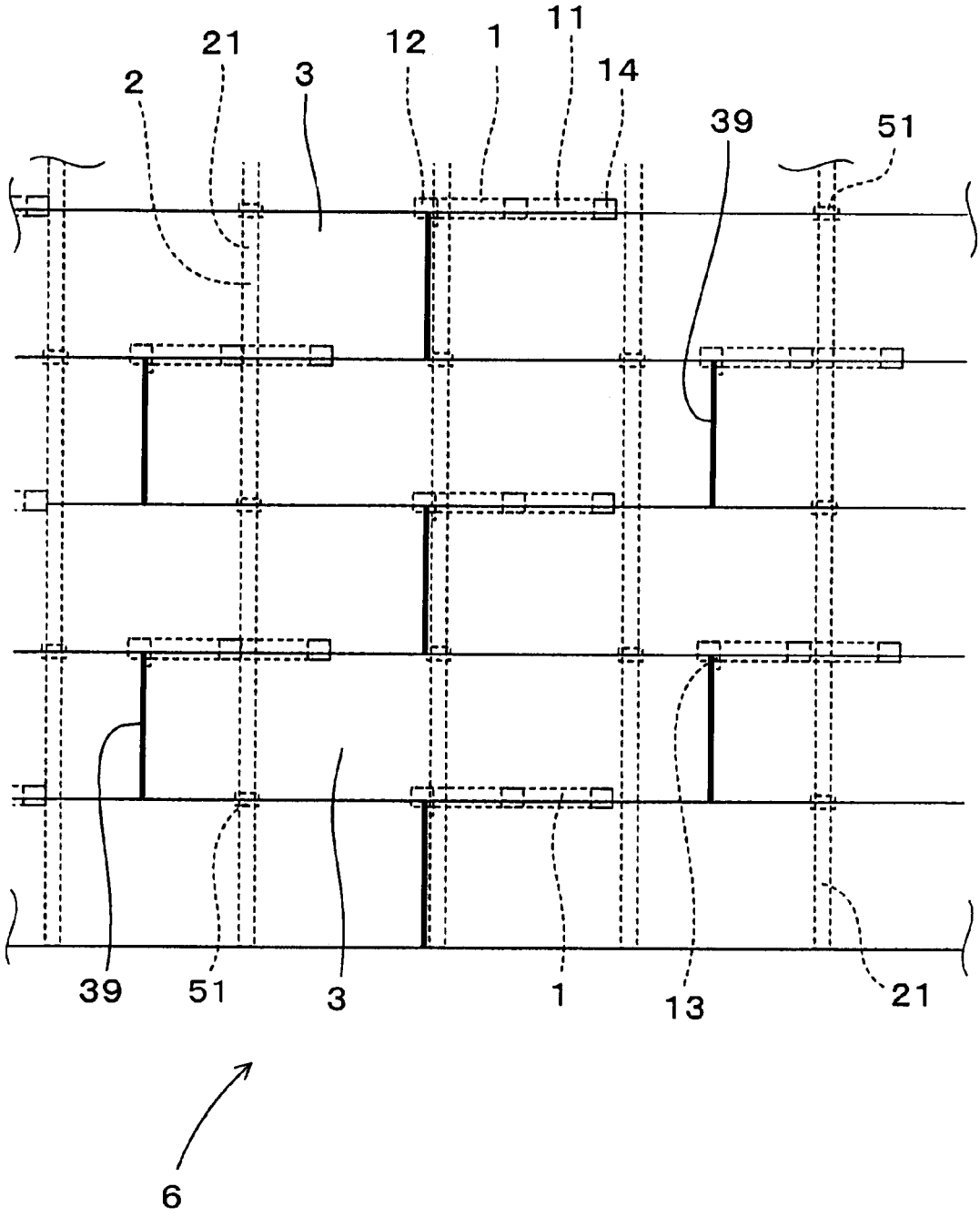
FIG. 1 is a front view of an external wall construction structure of the present invention.

A fastening member 1 of the present invention is, as shown in FIG. 1, a member for fixing a siding board 3 whose lateral joint portions 39 are disposed in a portion in a framework 2 of a building where no vertical member 21 is provided to the above framework 2.

Figure 2:
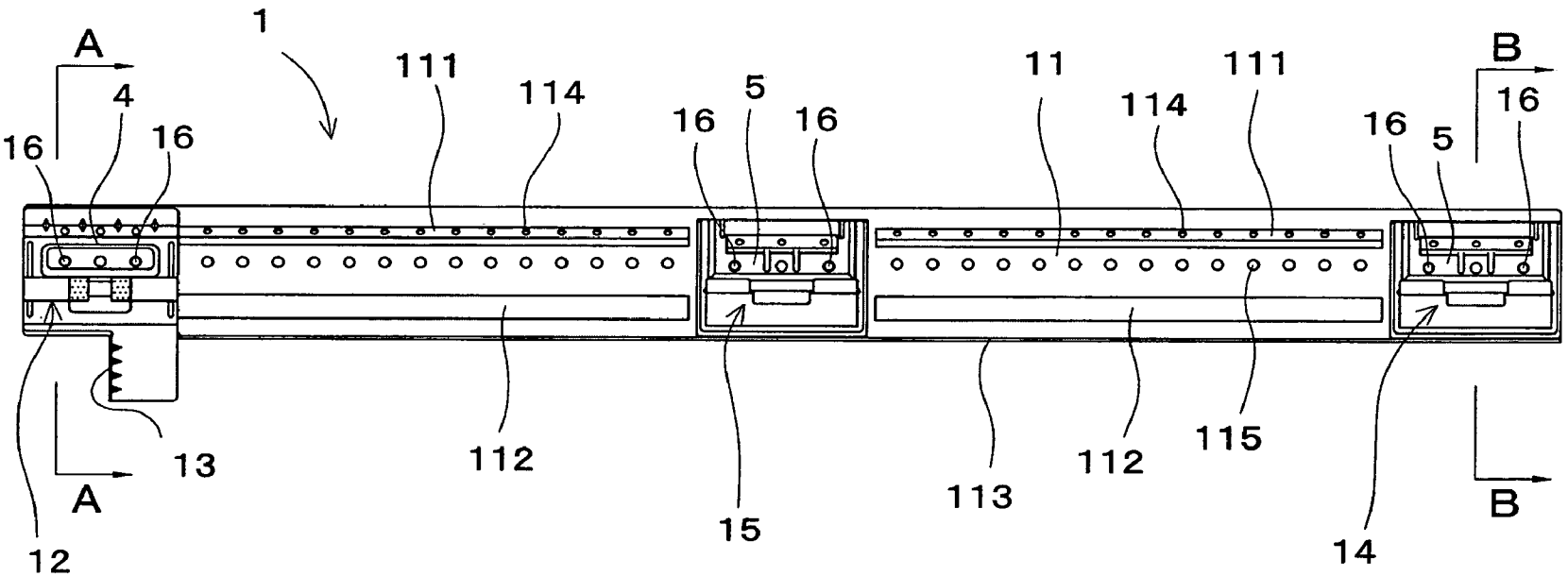
FIG. 2 is a front view of the fastening member of the present invention.

The above fastening member 1 has, as shown in FIG. 2, a long fixing plate portion 11 fixed to at least one vertical member 21 (not shown).

Figure 3:
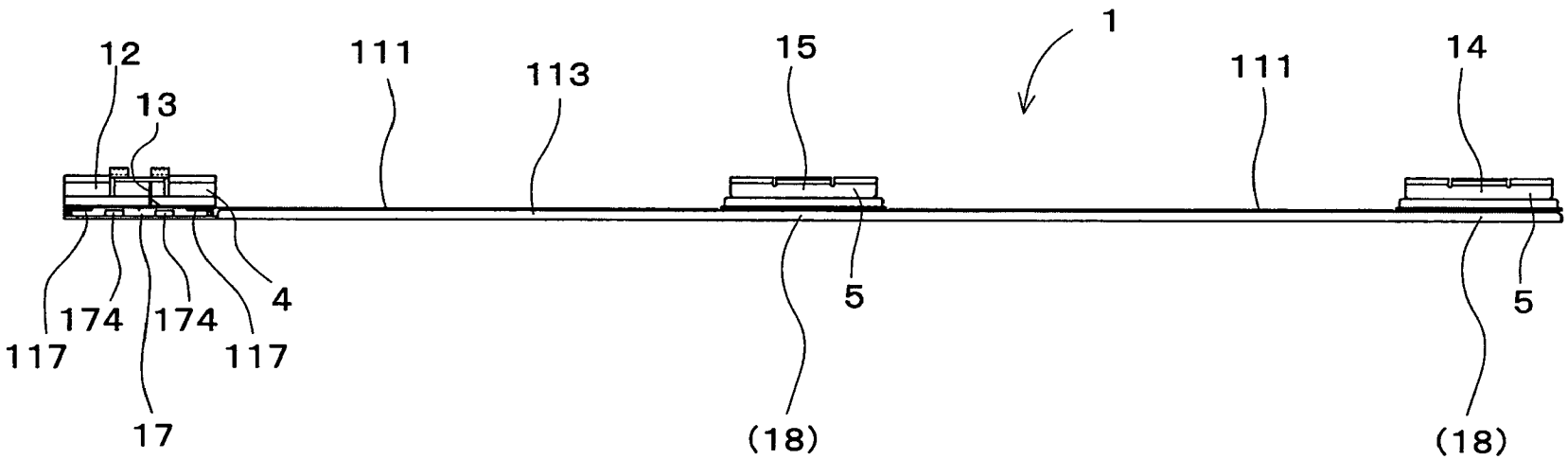
FIG. 3 is a bottom view of the fastening member of the present invention.

On the front surface of the long fixing plate portion 11, as shown in FIGS. 2 and 3, a first fastening portion 12 is provided at its left end; a vertical rising portion 13 for preventing displacement is provided therebelow; a second fastening portion 14 is provided at its right end; and a third fastening portion 15 is provided in an approximately middle position between the first and second fastening portions 12, 14.

Figure 4:
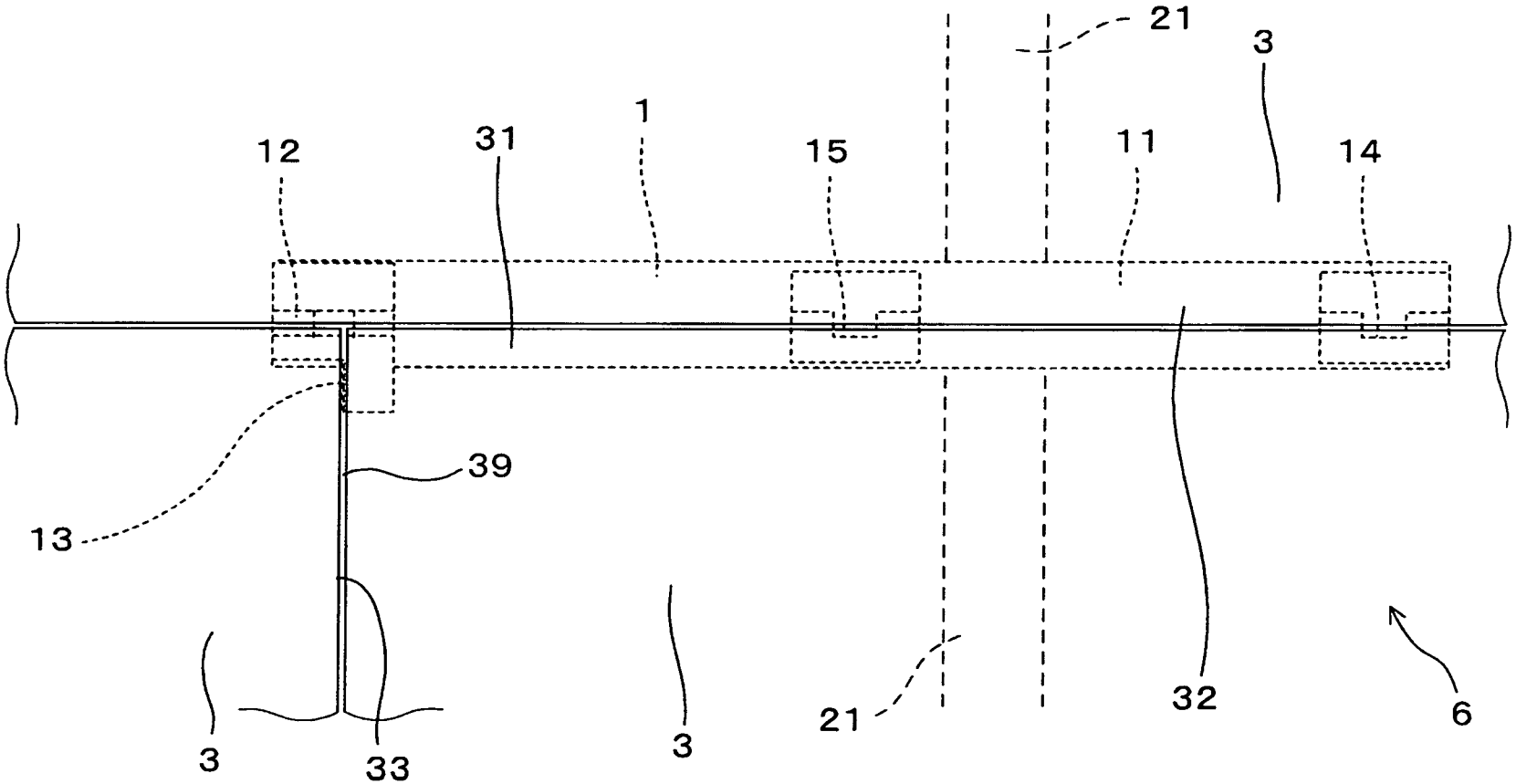
FIG. 4 is a front view of the external wall construction structure around the fastening member of the present invention.
Figure 5:
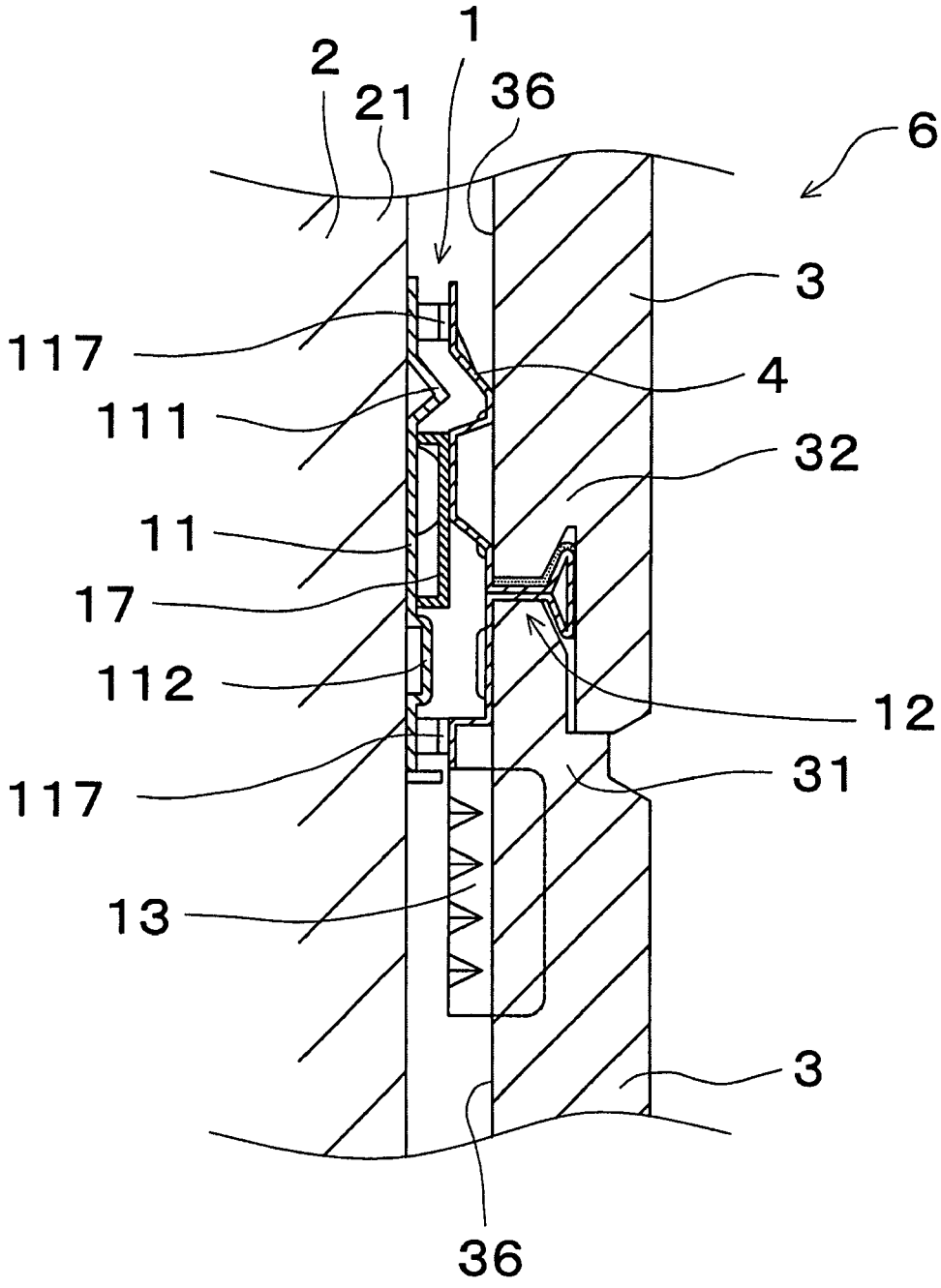
FIG. 5 is a cross-sectional view of the external wall construction structure taken along line A-A in FIG. 2 of the present invention.

The first fastening portion 12, as shown in FIGS. 4 and 5, engages an upper end portion 31 in the lateral joint portions 39 of the siding boards 3, 3 disposed thereunder, and supports and engages a lower end portion 32 of the siding boards 3, 3 disposed thereon.

The vertical rising portion 13 for preventing displacement is brought into contact with the right side edge (side end surface 33) of the siding board 3 disposed to the lower left of the first fastening portion 12.

Figure 6:
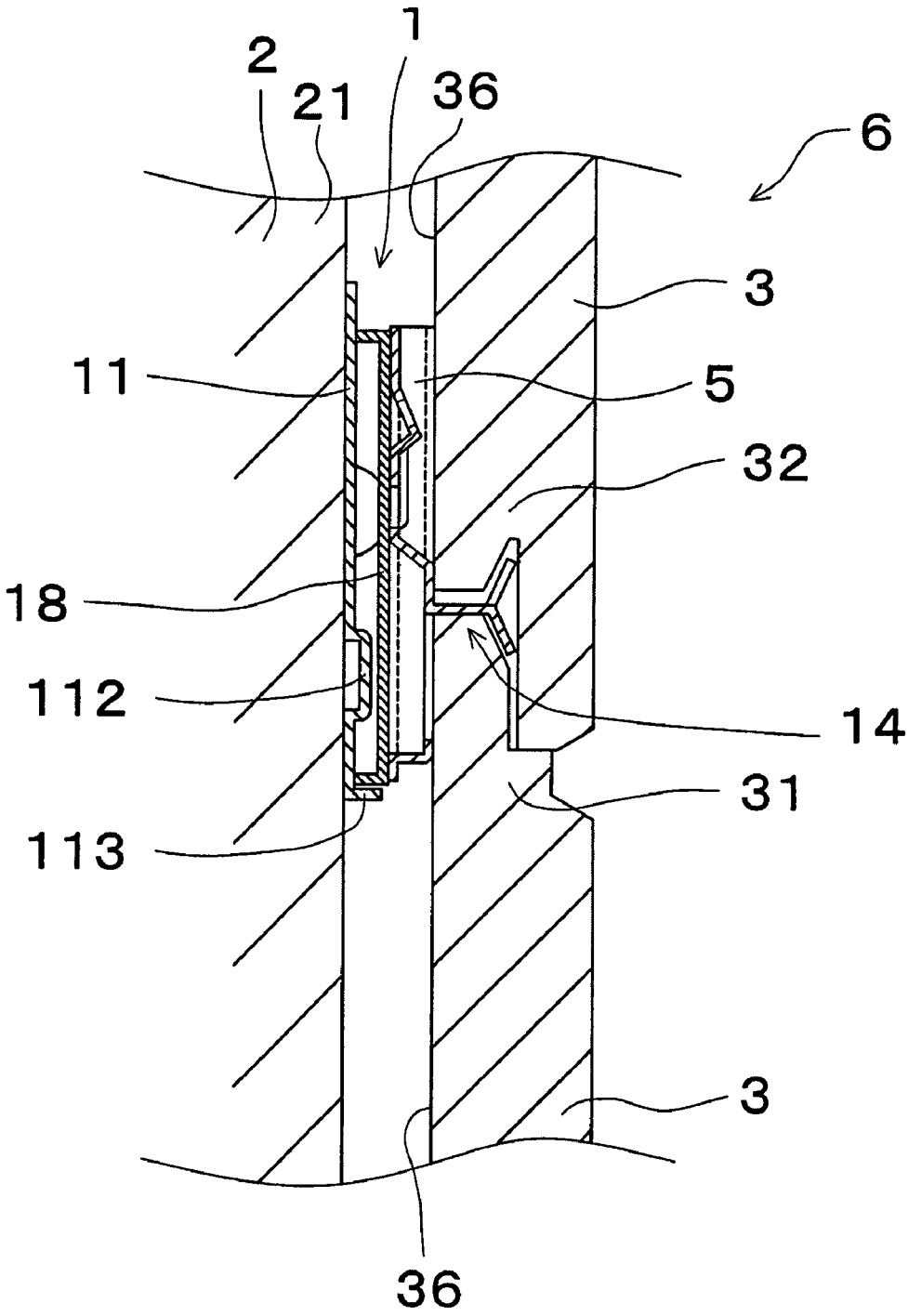
FIG. 6 is a cross sectional view of the external wall construction structure taken along line B-B of FIG. 2 of the present invention.

The second fastening portion 14, as shown in FIG. 6, engages the upper end portion 31 of the siding boards 3, 3 in the portion other than the lateral joint portions 39, and supports and engages the lower end portion 32 of the siding boards 3, 3 disposed thereabove.

Subsequently, the detailed constitution of this fastening member 1 will be described.

Figure 7:
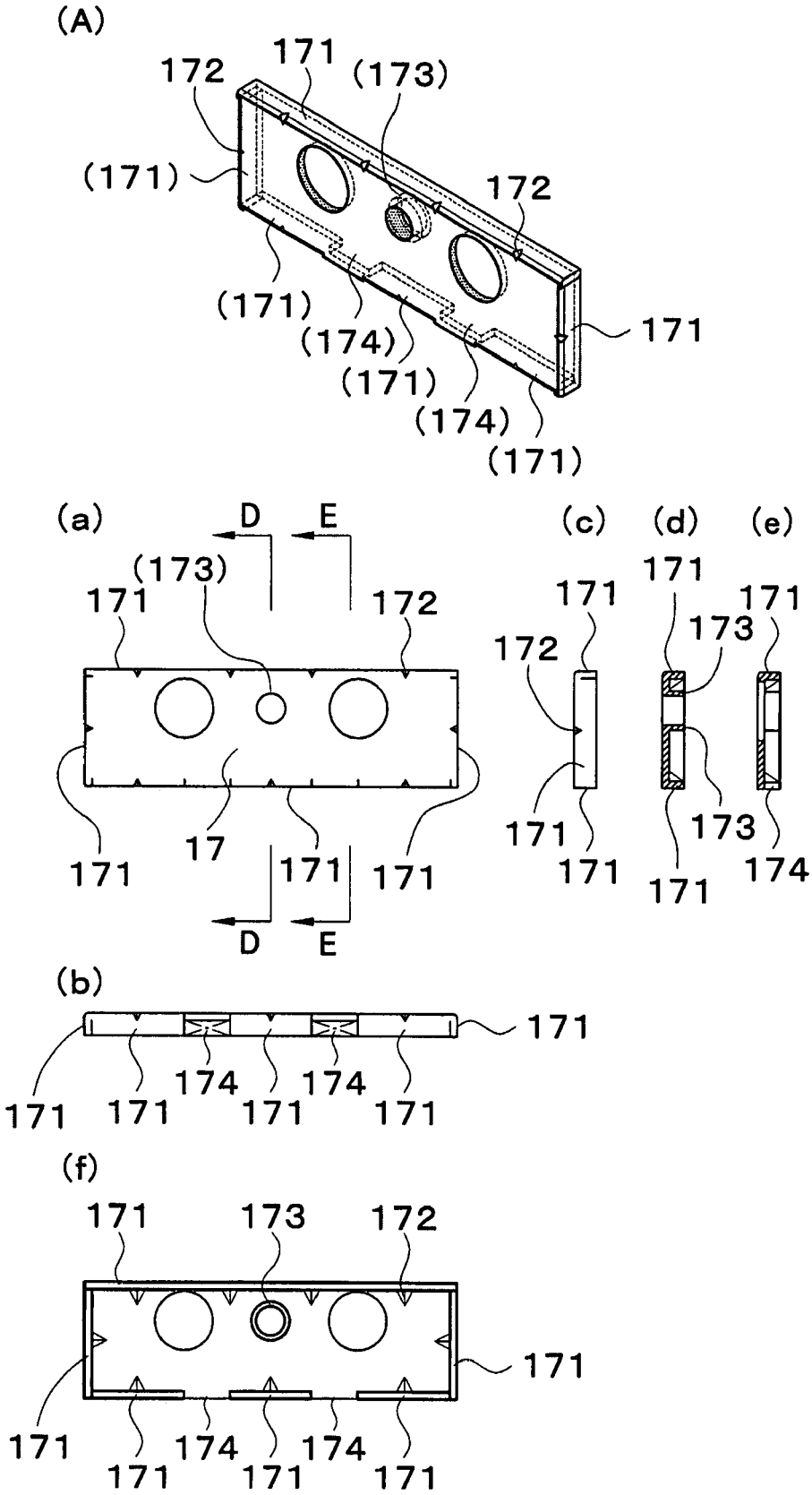
FIG. 7 shows the first ventilating spacer of the present invention, and (A) is a perspective view, (a) is a front view, (b) is a bottom view, (c) is a right side elevational view, (d) is a cross-sectional view taken along line D-D, (e) is a cross-sectional view taken along line E-E, and (f) is a back side view.

As shown in FIG. 7, the first ventilating spacer 17 provided in the first fastening portion 12 has bent portions 171 which are perpendicularly bent rearwardly from each side of the approximately rectangle-shaped metal plate. In the bent portions 171, a number of reinforcing ribs 172 are formed by locally deforming the metal plate. Moreover, in the opening air space portion in an approximately center of the first ventilating spacer 17, a reinforcing protrusion 173 is formed by a burring process.

Further, drain holes 174 are formed in a lower bent portion 171 of the first ventilating spacer 17. The drain holes 174 are formed by cutting out portions of the lower bent portion 171.

Figure 8:
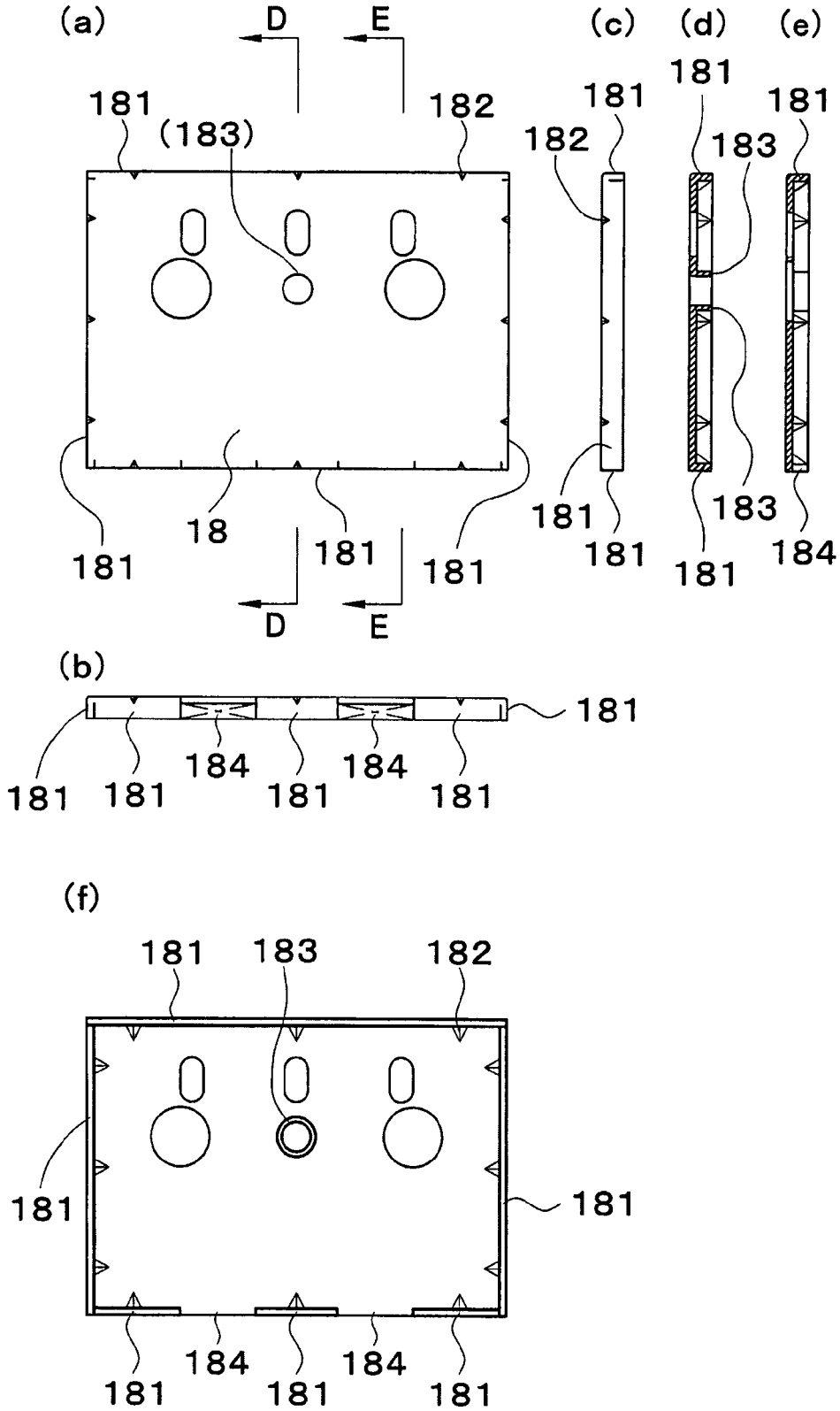
FIG. 8 shows the second ventilating spacer of the present invention, and (a) is a front view, (b) is a bottom view, (c) is a right side elevational view, (d) is a cross-sectional view taken along line D-D, (e) is a cross-sectional view taken along line E-E, and (f) is a back side view.

As shown in FIG. 8, the second ventilating spacer 18 provided on the second fastening portion 14 and the third fastening portion 15 also have bent portions 181 which are perpendicularly bent rearwardly from each side of the approximately rectangle-shaped metal plate. Moreover, a number of reinforcing ribs 182 are formed in the bent portions 181 by locally deforming the metal plate. Further, a reinforcing protrusion 183 is also formed in the opening portion in an approximately center of the second ventilating spacer 18 by a burring process.

Further, drain holes 184 are also formed in the lower bent portion 181 of the second ventilating spacer 18 in a similar manner. The drain holes 184 are formed by cutting out portions of the lower bent portion 181.

Figure 10:
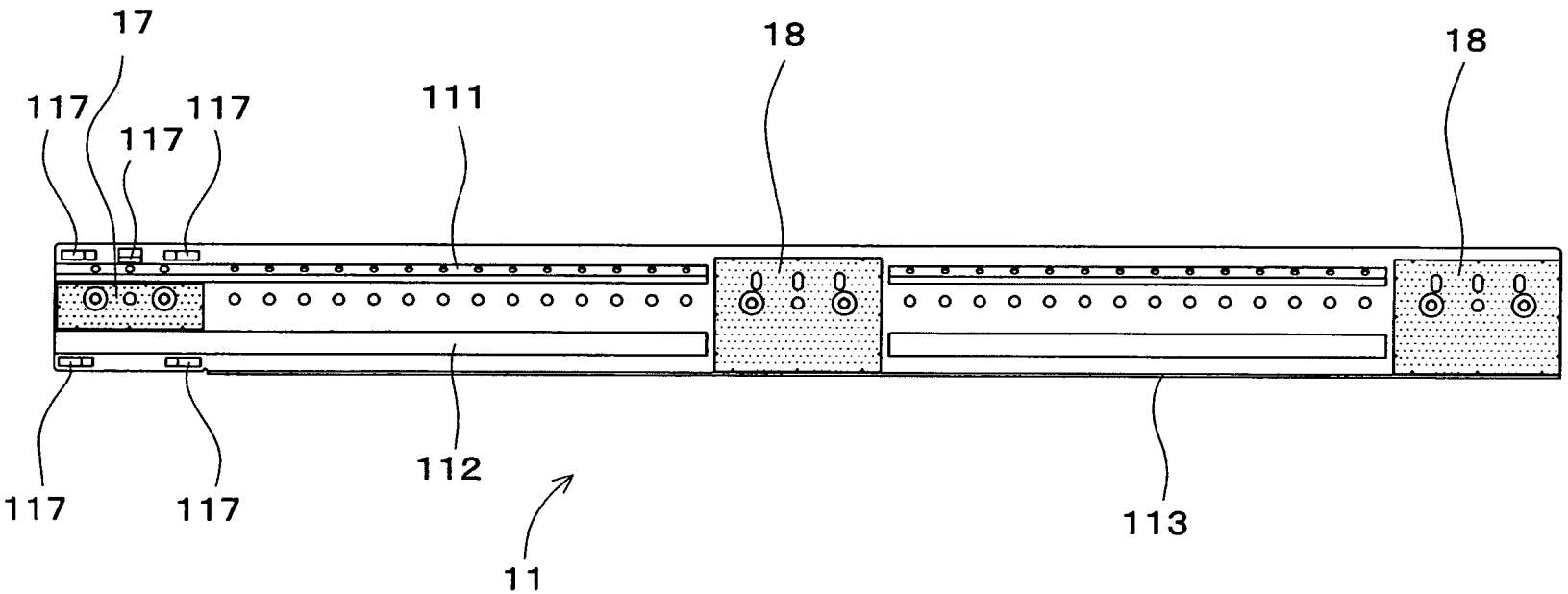
FIG. 10 is an illustrative drawing of the ventilating spacer position of the present invention.

As shown in FIG. 10, the first ventilating spacer 17 and second ventilating spacer 18 are provided on the front surface of the long fixing plate portion 11 in contact therewith. The bent portions 171 and reinforcing protrusion 173 shown in FIG. 7, and the bent portions 181 and reinforcing protrusion 183 shown in FIG. 8 have dimensions (dimensions of the total thickness) in the longitudinal direction depending on the dimension of a required ventilation space to function as a spacer. Moreover, since the first ventilating spacer 17 and the second ventilating spacer 18 are in contact with the long fixing plate portion 11, the vertical and horizontal dimensions of the first and second ventilating spacers 17 and 18 correspond to those of a rib portion (described later), and fixtures 4 and 5 (described later), respectively, so that they do not interfere with the rib portion which projects forwardly beyond the long fixing plate portion 11 and that their contact with the fixtures 4 having a stopper for prevention displacement and a fixture 5 mounted on the long fixing plate portion 11 is ensured.

As shown in FIGS. 2 and 3, this fastening member 1 is fixed to a front portion of the long fixing plate portion 11, respectively, in a state that the first ventilating spacer 17 is nipped between the fixture *4 having a stopper for preventing displacement which comprises the above-mentioned first fastening portion 12 and the vertical rising portion 13 for preventing displacement formed integrally and the long fixing plate portion 11 and the second ventilating spacer 18 is nipped between the fixture 5 constituting the above-mentioned second fastening portion 14 and the fixture 5 constituting the above third fastening portion 15 and the long fixing plate portion 11.

As shown in FIG. 2, the fixture 4 having a stopper for preventing displacement and the fixture 5 are fixed by swaging to the long fixing plate portion 11 in a state of nipping the first ventilating spacer 17 and the second ventilating spacer 18, respectively, in a swaged portion 16.

Figure 11:
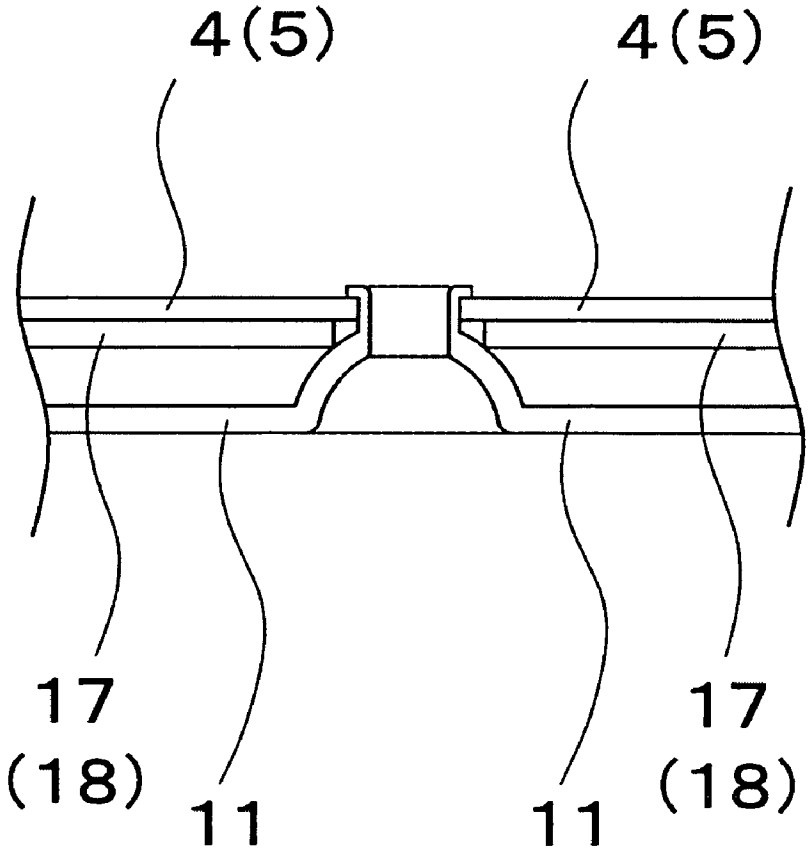
FIG. 11 is an illustrative drawing of the swaged portion of the present invention.

Specifically, as shown in FIG. 11, two or more portions between the long fixing plate portion 11 and the fixture 4 having a stopper for preventing displacement or the fixture 5 are subjected to a burring-swaging process. The burring-swaging process can prevent loosening better than fastening with screws, and can be fixed strongly once the process is finished. In the burring-swaging process, firstly, the opening portion projecting beyond the long fixing plate portion 11 and the opening portion of the first ventilating spacer 17 are aligned, and then the opening portion of the first ventilating spacer 17 and the opening portion of the fixture 4 having a stopper for preventing displacement are aligned. Similarly, the opening portion projecting beyond the long fixing plate portion 11 and the opening portion of the second ventilating spacer 18 are aligned, and then the opening portion of the second ventilating spacer 18 and the opening portion of the fixture 5 are aligned. Subsequently, a portion around the opening portion of the long fixing plate portion 11 is caused to project forwardly beyond the opening portions of the fixture 4 having a stopper for preventing displacement and the fixture 5, and the portion which is beyond the opening portions is bend on the front surface in a manner of nipping the fixture 4 having a stopper for preventing displacement and the fixture 5 in a state that the first ventilating spacer 17 and second ventilating spacer 18 are nipped, and is press-fitted to form the swaged portion 16.

This opening portion projecting beyond the long fixing plate portion 11 mentioned above, the reinforcing protrusion 173 of the first ventilating spacer 17, and the reinforcing protrusion 183 of the second ventilating spacer 18 are provided to prevent local deformation of the first ventilating spacer 17 and the second ventilating spacer 18 and further increase their strength. They are also provided to increase adhesion to the long fixing plate portion 11 and smoothly transmit the stress which is transmitted from the siding board to the fixture 4 having a stopper for preventing displacement and the fixture 5 to the long fixing plate portion 11.

Figure 9:
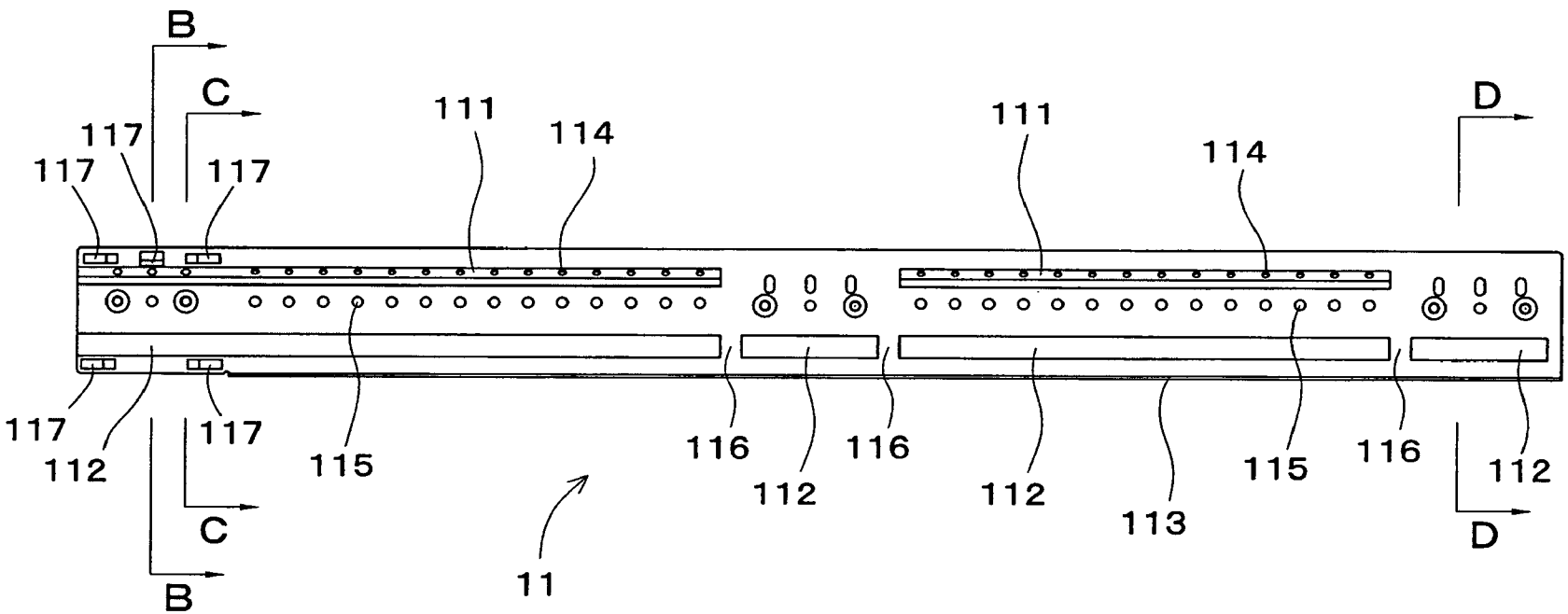
FIG. 9 is a front view of the long fixing plate portion before the fixture is attached of the present invention.
Figure 12:
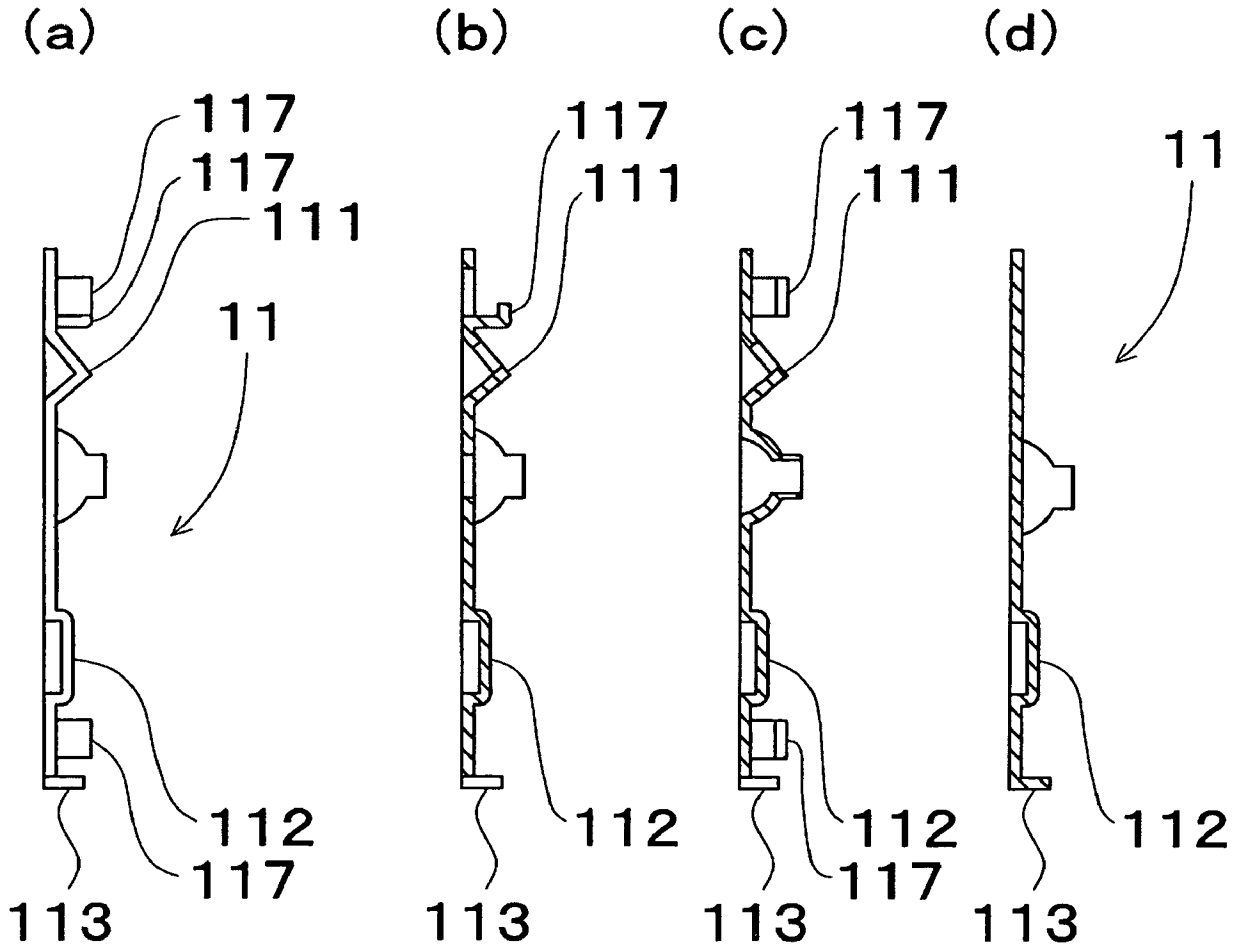
FIG. 12 shows the long fixing plate portion of the present invention, and (a) is a left side elevational view, (b) is a cross-sectional view taken along line B-B in FIG. 9, (c) is a cross-sectional view taken along line C-C in FIG. 9, and (d) is a cross-sectional view taken along line D-D in FIG. 9.
Figure 13:
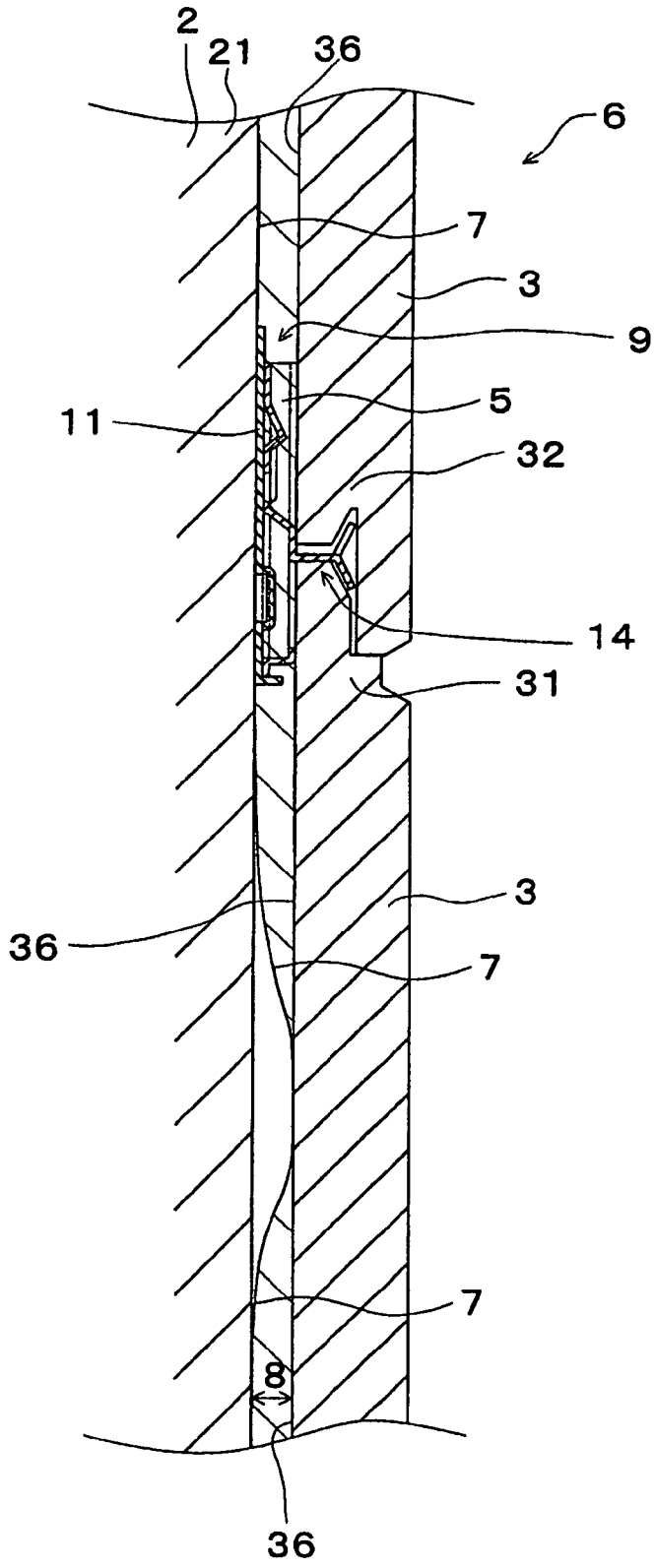
FIG. 13 is a perpendicular cross-sectional view of the external wall construction structure using a fastening member of a conventional invention.
Figure 14:
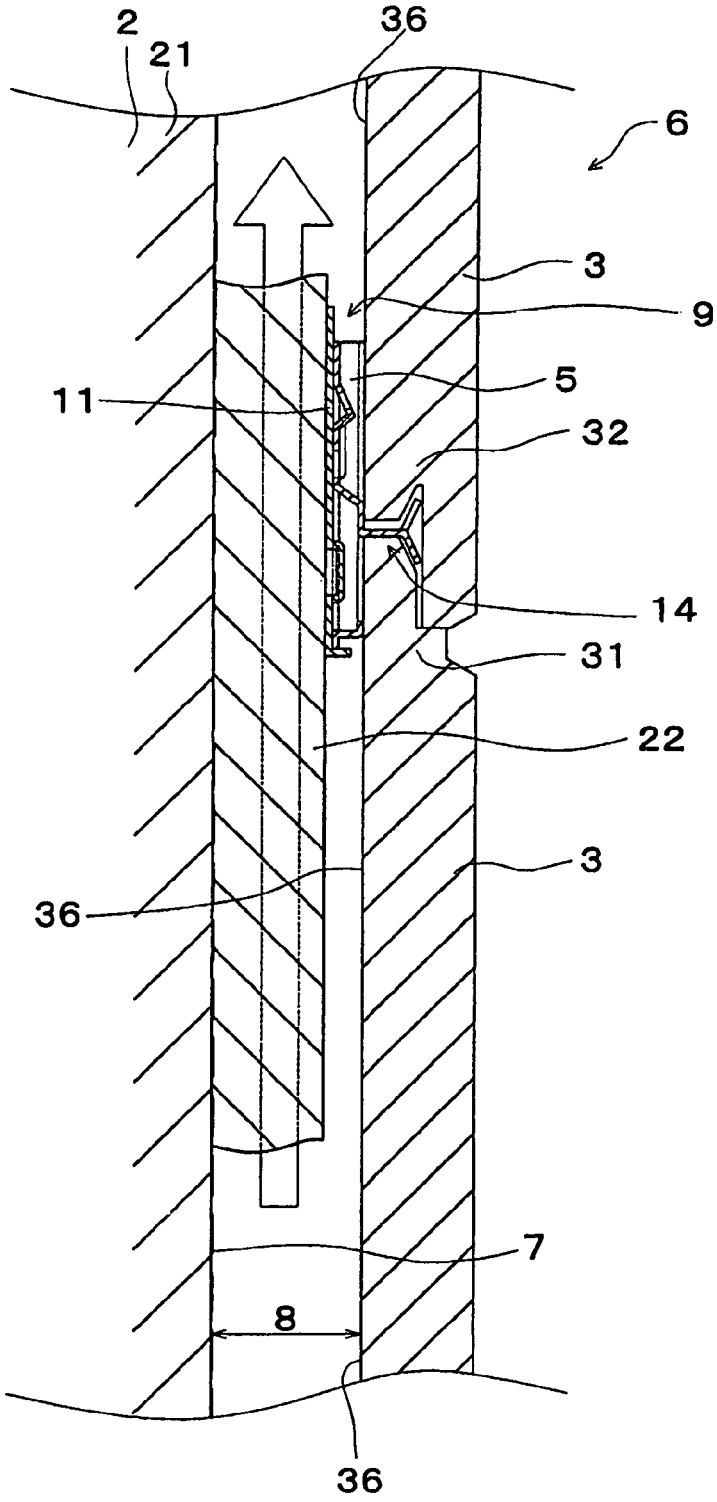
FIG. 14 is a perpendicular cross-sectional view of an external wall construction structure using furring strips and a fastening member of a conventional invention.
Figure 15:
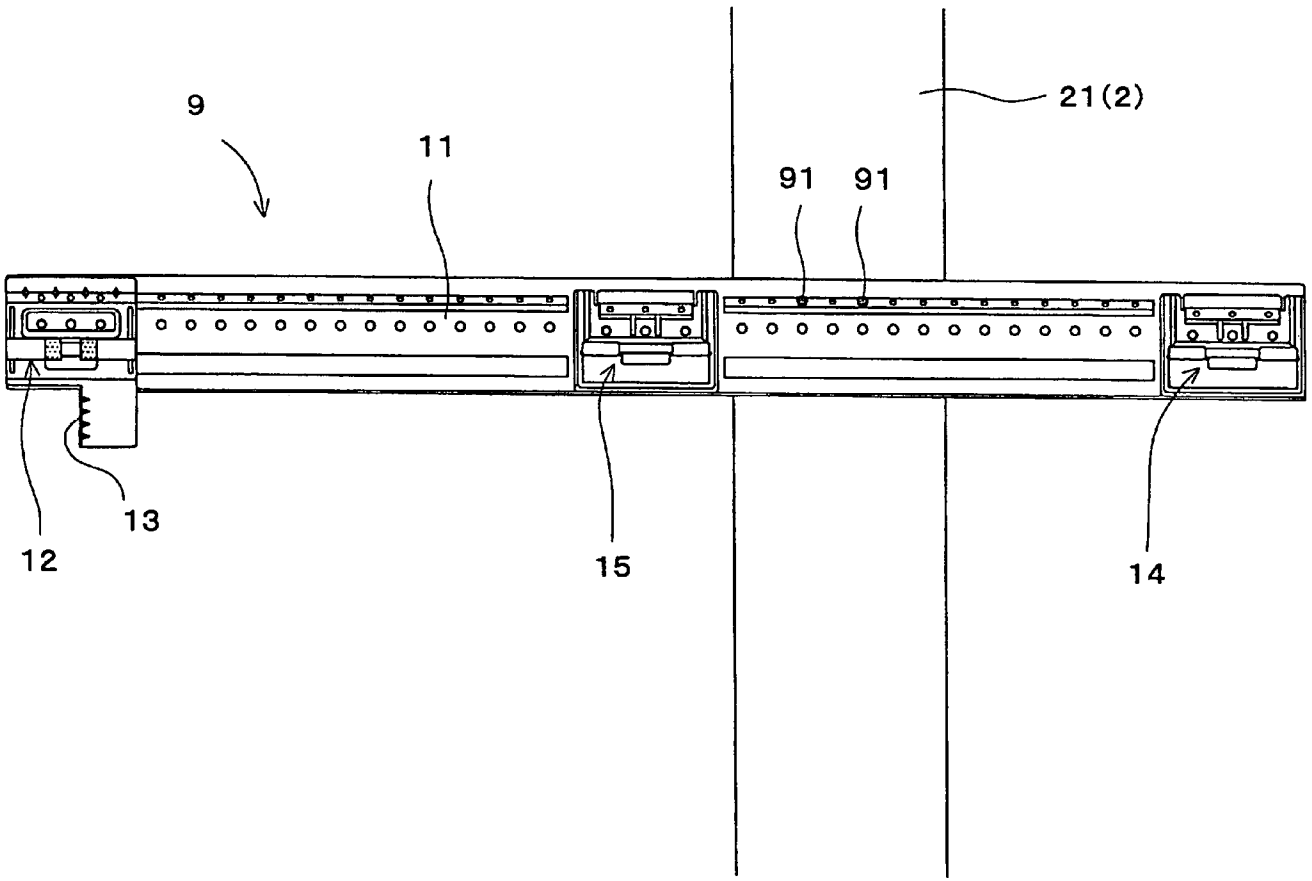
Fig. 15 PRIOR ART
FIG. 15 is a front view of an external wall construction structure using a fastening member of a conventional invention.

As shown in FIG. 9, a plurality of upper side rib portions 111 and lower side rib portions 112 projecting forwardly are formed on the long fixing plate portion 11 in the lateral direction, and a lower side bent portion 113 which is perpendicularly bent forwardly from the lower side of the long fixing plate portion 11 is formed (refer to FIG. 12). These upper side rib portions 111, lower side rib portions 112 and lower side bent portion 113 are provided to enhance the strength of the entire long fixing plate portion 11 and smoothly transmit the stress which is transmitted from the siding board to the fixture 4 having a stopper for preventing displacement and the fixture 5 to the vertical 21, which is a framework.

The long fixing plate portion 11 has a horizontal length of 650 mm. This length can cope with modules having a length of 500 mm to 610 mm.

In the long fixing plate portion 11, as shown in FIGS. 2 and 9, the rib portions 111 are not formed in a portion in which the fixture 5 is disposed to provide break portions 116 which are gaps in the rib portions 112. Accordingly, as shown in FIG. 10, the second ventilating spacer 18 is mounted on the long fixing plate portion 11 in a manner of contacting the same, and further the fixture 5 is mounted on the second ventilating spacer 18 in a manner of contacting the same. Moreover, the upper side rib portions 111 are projecting in such a manner that their cross sections are approximately triangle-shaped, and a number of nail holes 114 are formed on its upper slope at regular intervals (e.g., 15 mm interval) in the lateral direction.

A plurality of screw holes (bores) 115 are formed at regular intervals in the lateral direction (e.g., 15 mm interval) between the rib portions 111 and the rib portions 112. Therefore, the fastening member 1 can be securely screwed onto posts and stud portions with which the long fixing plate portion 11 is brought into contact.

The lower side bent portion 113, as shown in FIG. 9, is continuously formed in an inner portion in the vicinity of the left end of the long fixing plate portion 11 excluding the portion in which the fixture 4 having a stopper for preventing displacement is disposed.

The second ventilating spacer 18 is mounted in the vicinity of this lower side bent portions 113 (refer to FIG. 10).

Furthermore, as shown in FIGS. 9 and 12, a plurality of flange portions 117 are formed in an inner portion in the vicinity of the left end of the long fixing plate portion 11 excluding the portion in which the fixture 4 having a stopper for preventing displacement is disposed. The first ventilating spacer 17 is mounted on the long fixing plate portion 11 in a position which does not interfere with the upper side rib portions 111 and lower side rib portions 112 in a manner of contacting the long fixing plate portion 11. Furthermore, the fixture 4 having a stopper for preventing displacement is mounted on the first ventilating spacer 17 in a manner of contacting the same. However, the first ventilating spacer 17 is not mounted only on the front surface of the flange portion 117, but the fixture 4 having a stopper for preventing displacement is directly mounted on the flange portion 117 in a manner of contacting the same.

The flange portions 117 are formed by subjecting portions of the long fixing plate portion 11 to a cutting and bending process, and are for transmitting the stress of the fixture 4 having a stopper for preventing displacement directly to the long fixing plate portion 11 in a portion different from with the first ventilating spacer 17. Herein, if there were no flange portions 117 and unexpectedly great stress is transmitted from the fixture 4 having a stopper for preventing displacement only to the first ventilating spacer 17, because of an insufficiency of the area for the first ventilating spacer 17 and the fixture 4 having a stopper for preventing displacement to adherence to each other, the fixture 4 having a stopper for preventing displacement may be locally deformed. The purpose of providing the flange portions 117 is to increase this area for adheresion, prevent deformation of the fixture 4 having a stopper for preventing displacement, and increase its strength.

That is, the flange portions 117 are provided to increase safety by smoothly transmitting the stress transmitted from the fixture 4 having a stopper for preventing displacement to the long fixing plate portion 11, not only via the first ventilating spacer 17 but also via the flange portions 117.

In this specification, the term "front" means the outside of the building, and the term "rear" means the inside of the building. Moreover, regarding the above fastening member and other components, expressions such as "front", "rear", "above", "below", "horizontal" and "perpendicular", in a state of being attached to the framework, are used, among others. Moreover, the terms "left" and "right" means the directions which are "left" and "right", respectively, when the design side of the external wall is viewed from the front (refer to FIGS. 1 and 4).

The framework consists of a plurality of vertical members provided at a span of 610 mm. The framework is, for example, a wooden framework, and may be a framework of a framework construction structure, a framework of platform frame construction structure and various other frameworks.

Although a sufficient ventilation space can be ensured by directly fixing the fastening member to the vertical member, but when a larger ventilation space is to be ensured, the fastening member may be indirectly fixed to the vertical members via backing materials such as furring strips.

The framework to which the fastening member is fixed preferably has the disposition span of the vertical members of 500 to 610 mm, and the long fixing plate portion preferably has a horizontal length of 540 to 650 mm.

In this case, the fastening member can be easily fixed to at least one vertical member.

When the disposition span of the vertical members is more than 610 mm and 1000 mm or less, the long fixing plate portion preferably has a horizontal length of 1000 mm or less.

Examples of the siding board include a fiber reinforced cement siding type siding board.

The materials consituting the fastening member are metallic materials such as molten zinc-aluminium-magnesium alloy-plated steel plate and stainless steel. The long fixing plate portion, the fixture having a stopper for preventing displacement and the fixture are formed by subjecting a steel plate to cutting, bending and other processes.

The ventilating spacer can be any solid substance which can be nipped between the long fixing plate portion and the fixtures, and may be any material such as metals, resins, hard rubbers, and ceramics, as long as it is not easily deformed, broken, deteriorated over time or decayed even if it receives an external force (stress). Considering strength and durability, for example, metal plates of iron-plated and molten zinc-aluminium-magnesium alloy-plated steel plates and stainless steel plates and parts produced by bending these metal plates, and laminated metal plates are preferable. The thickness of metal plates themselves constituting the ventilating spacers may be any thickness as long as they are not easily deformed or broken even when the external force is applied thereto. For example, 1 mm or more is desirable in case of a metal plate such as iron.

Further, it is desirable that one or more drain holes are provided in a portion of one of the left, right and lower bent portions or the combinations thereof.

In this case, discharging water entering into the ventilating spacer in the lateral direction and downwardly is facilitated.

However, when the long fixing plate portion and most of the back side of the ventilating spacer are adhered, it is desirable to provide a groove which serves as a drain hole on the back side of the ventilating spacer downwardly.

The flange portion of the long fixing plate portion preferably is formed by cutting and bending a portion of the long fixing plate portion and has a configuration which allows contact with the fixture, but it can also have a configuration in which a portion of the long fixing plate portion is projected in the shape of a jut by a pressing process and burring process.

It is preferable that the first fastening portion is provided at one end of the long fixing plate portion, and the second fastening portion is provided at the other end of the long fixing plate portion.

In this case, the fastening member can be provided in the upper end portion and lower end portion of the siding board more stablely.

The fastening member preferably has the third fastening portion provided with a ventilating spacer portion having a configuration and function similar to the second fastening portion.

In this case, the fixing strength of the siding board can be improved.

The long fixing plate portion is preferably provided with a rib portion projecting forwardly in the lateral direction and a lower side bent portion bent forwardly from the lower side of the long fixing plate portion.

In this case, the strength of the long fixing plate portion can be ensured.

It is preferable to provide a gap between the lower side bent portion and the second ventilating spacer of the long fixing plate portion.

In this case, water entering into the second ventilating spacer flows down the drain hole, and then flows fowardly and downwardly in the lateral direction of the lower side bent portion through the gap, whereby stagnation of water can be prevented and generation of rust on the fastening member can be inhibited The long fixing plate portion is preferably provided with an opening portion projecting forwardly.

In the first fastening portion, when the first ventilating spacer and the fixture having a stopper for preventing displacement are fixed to the long fixing plate portion, the opening portion of the long fixing plate portion projecting forwardly and the opening portion of the first of the ventilating spacer are aligned and then the opening portion of the first ventilating spacer and the opening portion of the fixture having a stopper for preventing displacement are aligned, whereby positioning of the first ventilating spacer and the fixture having a stopper for preventing displacement in the vertical and lateral directions in their attachment can be easily carried out only by aligning these opening portions.

Similarly in the second fastening portion, when the second ventilating spacer and the fixture are fixed to the long fixing plate portion, the opening portion of the long fixing plate portion projecting forwardly and the opening portion of the second ventilating spacer are aligned and then the opening portion of the second ventilating spacer and the opening portion of the fixture are aligned, whereby positioning of the second ventilating spacer and the fixture in the vertical and lateral directions in their attachment can be easily carried out only by aligning these opening portions.

It is preferable that the fastening member has the third fastening portion provided with a ventilating spacer portion having a configuration and function similar to the second fastening portion and the third fastening portion engages the upper end portion of the siding board in the portion other than the lateral joint portions and supports and engages the lower end portion.

In this case, the fixing strength of the siding board can be improved, and the construction structure of external walls having excellent durability can be obtained.

It is desirable that the fastening member has such a thickness and configuration that the long fixing plate portion is not easily deformed and the first fastening portion, the second fastening portion and the third fastening portion are disposed on a straight line in the horizontal and front-and-rear direction.

In this case, in the lateral joint portions of the siding boards, the horizontally adjacent upper end portions of the siding boards are simultaneously engaged on a straight line and the lower end portions of the siding boards disposed above those siding boards are supported on a straight line, whereby displacement in the joints of the siding boards can be reduced and the siding boards can be engaged without warping, thereby obtaining external wall construction structure with an improved aesthetic quality.

What is claimed is:

1. A fastening member for fixing a siding board on a framework of a building wherein lateral joint portions of the siding board are disposed in a portion where no vertical member is provided on the framework, the fastening member comprising a long fixing plate portion fixed on at least one vertical member, a first fastening portion having a fixture for supporting and engaging an upper end portion of the lateral joint portions of the siding board and a lower end portion of the siding board thereabove on the front surface of the long fixing plate portion, a first vertical rising portion for preventing displacement disposed in the lateral joint portions of the siding board below the first fastening portion, a second fastening portion having a fixture for engaging the upper end portion of the siding board other than the lateral joint portions and for supporting and engaging the lower end portion of the siding board other than the lateral joint portions on the front surface of the long fixing plate portion, and a ventilating spacer provided in the first fastening portion and second fastening portion and nipped between the long fixing plate portion and each of the fastening portions, respectively, wherein said ventilating spacer has a bent portion which is perpendicularly bent from each side of an approximately rectangle-shaped metal plate rearwardly, and an opening portion in an approximate center, and further the bent portion has a reinforcing rib which is the metal plate locally deformed and a reinforcing protrusion in the opening portion.

2. A fastening member according to claim 1, wherein the ventilating spacer has a drain hole in the bent portion.

3. A fastening member according to claim 1, wherein a portion around an opening portion of the long fixing plate portion is protruded, the opening portion of the ventilating spacer and an opening portion of each fixture are aligned relative to the opening portion, and the bent portion of the ventilating spacer and the edge of the reinforcing protrusion are brought into contact with the long fixing plate portion, and in a state that the fixture is in contact with the ventilating spacer, the raised portion around the opening portion in the long fixing plate portion projects forwardly beyond the opening portion of each fixture, and this protruding portion is rearwardly bent on the front surface of each fixture and pressed against the front surface portion of the long fixing plate portion, whereby the ventilating spacer and each fixture are integrally fixed to the long fixing plate portion.

4. A fastening member according to claim 3, wherein the first fastening portion has a plurality of flange portions which are formed by subjecting a portion of the long fixing plate portion to a cutting and bending process, and the fixture is mounted on the flange portions in direct contact with the flange portions.

5. A fastening member according to claim 1, wherein the first fastening portion is provided at one end of the long fixing plate portion, and the second fastening portion is provided at the other end of the long fixing plate portion.

6. A fastening member according to claim 1, wherein the fastening member further has a third fastening portion having a configuration and function similar to those of the second fastening portion.

7. A fastening member according to claim 1, wherein the fixture constituting the first fastening portion is a fixture having a stopper for preventing displacement which comprises a second vertical rising portion for preventing displacement integrally formed thereon.

8. A fastening member according to claim 1, wherein the long fixing plate portion has a rib portion protruding forwardly in the lateral direction and a lower side bent portion bent forwardly from the lower side of the long fixing plate portion formed thereon.

9. An external wall construction structure using the fastening member according to claim 1.

10. An external wall construction structure according to claim 9, wherein the framework has a vertical member disposition span of 500 to 610 mm, and the long fixing plate portion has a horizontal length of 540 to 650 mm.

11. A fastening member according to claim 2, wherein a portion around an opening portion of the long fixing plate portion is protruded, the opening portion of the ventilating spacer and an opening portion of each fixture are aligned relative to the opening portion, and the bent portion of the ventilating spacer and the edge of the reinforcing protrusion are brought into contact with the long fixing plate portion, and in a state that the fixture is in contact with the ventilating spacer, the raised portion around the opening portion in the long fixing plate portion projects forwardly beyond the opening portion of each fixture, and this protruding portion is rearwardly bent on the front surface of each fixture and pressed against the front surface portion of the long fixing plate portion, whereby the ventilating spacer and each fixture are integrally fixed to the long fixing plate portion.

12. A fastening member according to claim 11, wherein the first fastening portion has a plurality of flange portions which are formed by subjecting a portion of the long fixing plate portion to a cutting and bending process, and the fixture is mounted on the flange portions in direct contact with the flange portions.

13. A fastening member according to claim 1, wherein the first fastening portion is provided at one end of the long fixing plate portion, and the second fastening portion is provided at the other end of the long fixing plate portion.

14. A fastening member according to claim 2, wherein the first fastening portion is provided at one end of the long fixing plate portion, and the second fastening portion is provided at the other end of the long fixing plate portion.

15. A fastening member according to claim 5, wherein the fastening member further has a third fastening portion having a configuration and function similar to those of the second fastening portion.

16. A fastening member according to claim 6, wherein the fixture constituting the first fastening portion is a fixture having a stopper for preventing displacement which comprises a second vertical rising portion for preventing displacement integrally formed thereon.

17. A fastening member according to claim 7, wherein the long fixing plate portion has a rib portion protruding forwardly in the lateral direction and a lower side bent portion bent forwardly from the lower side of the long fixing plate portion formed thereon.

18. An external wall construction structure using the fastening member according to claim 1.

19. An external wall construction structure using the fastening member according to claim 3.

* * * * *